US011071435B2

(12) United States Patent
Kessler et al.

(10) Patent No.: US 11,071,435 B2
(45) Date of Patent: Jul. 27, 2021

(54) DOSING DEVICE FOR A CLEANING MACHINE

(71) Applicant: Henkel AG & Co. KGaA, Duesseldorf (DE)

(72) Inventors: Arnd Kessler, Monheim am Rhein (DE); Thomas Weber, Weimar (DE); Johannes Zipfel, Amsterdam (NL); Christian Nitsch, Duesseldorf (DE); Lars Zuechner, Langenfeld (DE); Nadine Franke, Cologne (DE); Georg Wawer, Vienna (AT); Alexander Mueller, Monheim (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days.

(21) Appl. No.: 16/468,853

(22) PCT Filed: Dec. 7, 2017

(86) PCT No.: PCT/EP2017/081849
§ 371 (c)(1),
(2) Date: Jun. 12, 2019

(87) PCT Pub. No.: WO2018/114358
PCT Pub. Date: Jun. 28, 2018

(65) Prior Publication Data

US 2020/0069146 A1 Mar. 5, 2020

(30) Foreign Application Priority Data

Dec. 21, 2016 (DE) ..... 10 2016 225 810.9

(51) Int. Cl.
*A47L 15/00* (2006.01)
*A47L 15/44* (2006.01)
(Continued)

(52) U.S. Cl.
CPC ..... *A47L 15/0055* (2013.01); *A47L 15/4463* (2013.01); *A47L 15/4472* (2013.01);
(Continued)

(58) Field of Classification Search
None
See application file for complete search history.

(56) References Cited

U.S. PATENT DOCUMENTS 8,182,615 B2 5/2012 Classen et al.
2010/0132748 A1 6/2010 Kessler et al.

FOREIGN PATENT DOCUMENTS

DE 102005062479 A1 7/2007
DE 102007014425 A1 9/2008
(Continued)

OTHER PUBLICATIONS

DE102012109560A1 Whirlpool translation, retrieved from Google Patents on Nov. 10, 2020 (Year: 2020).*
(Continued)

*Primary Examiner* — Eric W Golightly
(74) *Attorney, Agent, or Firm* — Lorenz & Kopf, LLP

(57) ABSTRACT

A system for dosing substances such as cleaning and/or care agents is disclosed. The system includes a dosing device, at least one energy source, a control unit, a sensor unit, and at least two cartridges for respectively accommodating at least one of the cleaning and/or care agents. The at least two cartridges are capable of being coupled to the dosing device.

14 Claims, 7 Drawing Sheets

(51) Int. Cl.

| | |
|---|---|
| ***C11D 3/00*** | (2006.01) |
| ***C11D 11/00*** | (2006.01) |
| ***C11D 17/04*** | (2006.01) |
| ***D06F 33/00*** | (2020.01) |
| ***D06F 39/02*** | (2006.01) |
| ***D06F 58/20*** | (2006.01) |

(52) U.S. Cl.
CPC ..... *C11D 3/001* (2013.01); *C11D 3/0068* (2013.01); *C11D 11/0017* (2013.01); *C11D 11/0023* (2013.01); *C11D 17/046* (2013.01); *D06F 33/00* (2013.01); *D06F 39/024* (2013.01); *D06F 58/203* (2013.01)

(56) References Cited

FOREIGN PATENT DOCUMENTS

| | | | |
|---|---|---|---|
| DE | 102010003770 | A1 | 10/2011 |
| DE | 102010031621 | A1 | 1/2012 |
| DE | 102010027993 | A1 | 5/2012 |
| DE | 102010062138 | A1 | 5/2012 |
| DE | 102012109560 | A1 | 5/2013 |
| EP | 1759624 | A2 | 3/2007 |
| WO | 02077353 | A1 | 10/2002 |

OTHER PUBLICATIONS

DE102010003770A1 BSH translation, retrieved from Google Patents on Nov. 12, 2020 (Year: 2020).*
EPO, International Search Report and Written Opinion issued in International Application No. PCT/EP2017/081849, dated Apr. 10, 2018.

* cited by examiner

DOSING DEVICE FOR A CLEANING MACHINE

CROSS-REFERENCE TO RELATED APPLICATIONS

This application is a U.S. National-Stage entry under 35 U.S.C. § 371 based on International Application No. PCT/EP2017/081849, filed Dec. 7, 2017, which was published under PCT Article 21(2) and which claims priority to German Application No. 10 2016 225 810.9, filed Dec. 21, 2016, which are all hereby incorporated in their entirety by reference.

TECHNICAL FIELD

The present disclosure relates to a dosing device for dosing substances such as cleaning and/or care agents.

BACKGROUND

In the context of the application, cleaning machines such as dishwasher detergents or washing machines are available to the consumer in multiple forms. In addition to the traditional liquid manual dishwasher detergents, in particular, the proliferation of household dishwashers has meant that automatic dishwasher detergents have become very important. These automatic dishwasher detergents are typically offered to the consumer in the solid form, for example as a powder or as tablets, but now increasingly also in the liquid form. A primary focus for some time has been ease of dosing of washing and cleaning agents and the simplification of the operational steps required to carry out a washing or cleaning method.

Furthermore, one of the main aims of the manufacturer of automatic cleaning agents is improving the cleaning power of these agents, wherein most recently, greater emphasis has been placed on the cleaning power for low temperature cleaning operations or in cleaning operations with a reduced water consumption. To this end, the cleaning agents were advantageously supplemented with new ingredients, for example more effective surfactants, polymers, enzymes or bleaching agents. However, because only a restricted range of new ingredients was available and the quantity of the ingredients used per cleaning operation cannot be increased ad infinitum for ecological and economic reasons, there obviously are limits to this solution strategy.

In this connection, very recently, devices for delivering multiple doses of washing, care and cleaning agents have in particular been focused upon by the product developer. Among these devices, there is a distinction to be drawn between dosing chambers integrated into the dishwasher on the one hand and stand-alone devices which are independent of the dishwasher on the other hand. Using these devices, which contain many times the quantity of cleaning agent required for carrying out a cleaning process, washing or cleaning agent portions are automatically or semi-automatically dosed into the interior of a dishwasher during a plurality of successive cleaning processes. The consumer does not need to carry out manual dosing for every cleaning or washing operation. Examples of such devices have been described in European patent application EP 1 759 624 A2 or in German patent application DE 53 5005 062 479 A1.

In addition, when the available washing and cleaning agents carry out many other functions in addition to actual cleaning such as, for example, water softening, glass protection, silver protection and the like, as a rule these washing and cleaning agents also include even more auxiliary cleaning agents and care agents. These can, for example, support automatic cleaning. Examples in this regard are cleaning boosters, rinse aids, softening salt or glass protectors. Furthermore, other cleaning and care agents can guarantee or support the care and/or sanitization of a dishwasher and/or of crockery between cleaning operations of the dishwasher. Examples in this regard are dishwasher deodorants, dishwasher cleaners or seal protectors. As a rule, these further cleaning and care agents are provided as individual products. Dosing is carried out as a function of the form in which it is manufactured, periodically/manually (for example dishwasher cleaner) or continuously/automatically (for example dishwasher deodorant). Dosing these cleaning and care agents is actually only poorly matched up with the actual need and as a rule is predetermined by the standardized size of the agents. In addition, employing of a plurality of other cleaning and care agents requires the use of different products which each have to be positioned inside the dishwasher at different times and at different locations.

In this regard, easier dosing of these other cleaning and care agents and appropriate dosing of the other cleaning and care agents would be advantageous.

SUMMARY

In the light of this prior art, it is thus the objective of the present disclosure to at least partially alleviate or avoid the described problems, and in particular to enable dosing of supplementary cleaning and/or care agents to be easier and appropriate.

For these reasons, a physical dosing device in accordance with claim 1 is proposed. In particular, a system comprises a dosing device for dosing a substance chosen from cleaning and/or care agents, a control unit, a sensor unit, and at least two cartridges for respectively accommodating at least one of the cleaning and/or care agents, wherein the at least two cartridges are respectively capable of being coupled to the dosing device, and optionally comprising a communication interface.

Cartridge

The term "cartridge" as used in the context of this application should be understood to mean a packaging suitable for sheathing or holding together flowable or spreadable substances such as cleaning and/or care agents and which, in order to dispense the substance, can preferably be coupled to a dosing device. Optionally, the dosing device comprises a communication interface. The substance which can be accommodated in the cartridge is intended for repeated dosing. The dosing device preferably comprises at least two cartridges which can each be coupled to the dosing device. At least one, preferably each of the cartridges may be releasably coupled to the dosing device.

In an exemplary embodiment, the cartridges may each be configured to accommodate cleaning and/or care agent which are respectively different from each other. Alternatively, each of the cartridges may be envisaged as being configured to accommodate an identical cleaning and/or care agent.

In an exemplary embodiment, one or more of the cleaning and/or care agents listed below may be accommodated in at least one of the cartridges:

cleaning booster substance;
shine and drying booster substance;
softening salt;
glass protection substance;
deodorizing substance;
machine cleaning substance;
care substance.

A cleaning booster substance, a shine and drying booster substance, a softening salt as well as a glass protection substance as the cleaning and/or care agent support automatic dishwasher cleaning. A deodorizing substance, a machine cleaning substance, as well as a care substance support the care and/or hygiene of a cleaning machine and/or of crockery between the automatic cleaning operations of the dishwasher or laundry during the washing procedure.

A cleaning booster substance may, for example, act to intensify the cleaning power of a further cleaning and/or care agent. In particular, enzymes, alkalization agents, surfactants and bleaching agents or bleaching catalysts are suitable as cleaning booster substances.

A shine and drying booster substance is also, for example, known as a rinse aid and has a rinsing and drying function. This substance may, for example, comprise a rinse and drying surfactant.

A softening salt comprises, for example, a softening function, wherein mostly, the principle of crystal growth inhibition using special polymer systems and phosphonates to inhibit limescale deposits is applied. Typically in this regard, variations of sulfonated polyacrylates, ethylenediamine succinic acid (EDDS), methylglycinediacetic acid (MGDA) are used, which are all readily soluble in water. Because of the limited space/volume inside a cartridge, solutions of the said substances and mixtures of substances which have concentrations which are as high as possible are used for repeated dosing when used with a dishwasher may be stored in them. The substances and mixtures of substances cited above with a softening function may, for example, be fortified with softening functions for automatic cleaning, such as surfactants, carboxylic acids, solvents, solubility promoters, dyes, aromatic substances or the like.

A glass protection substance may, for example, be a zinc or bismuth salt or a polyimine which acts to inhibit diffusion at a boundary between glass and water. The substances, in particular zinc or bismuth salts, may, for example, react with other ingredients of a cleaning and/or care agent or with water and be deactivated thereby, for example by precipitation. Correspondingly, for example, dosing of a glass protection substance independently of other cleaning and/or care agents may alleviate or completely prevent this deactivation.

A deodorizing substance may, for example, be one or more aromatic substances and/or odor inhibitors, in particular dispensed (for example constantly) at least between the automatic cleaning cycles of a dishwasher. Correspondingly, for example, dispensing of deodorizing substance may be activated when this function is needed and/or desired (for example between the cleaning cycles of a dishwasher), and be deactivated again after use. In particular, a deodorizing substance may cover and/or neutralize specific aromatic substances associated with bad odors, such as sulfur-containing fragrancing substances, for example dimethyldisulfide or dimethylsulfide, volatile carboxylic acids, for example succinic acid, acetic acid or valeric acid, volatile hydrocarbons, for example limonene, myrcene or pinene, and/or nitrogen-containing compounds such as, for example, pyrazines, pyridines, amines or ammonia.

A mechanical cleaning substance or a care substance prevents, inter alia, the buildup of deposits of limescale and/or grime inside a cleaning machine. In particular, in order to carry out cleaning operations, acids, acid mixtures, surfactants and/or chelating agents which are dosed by the dosing device are suitable as machine cleaning substances. Corrosion inhibitors and/or lubricants and glide agents, in particular to care for the seals of a cleaning machine, may be used as care substances, in particular for a dishwasher.

In an exemplary embodiment, the at least two cartridges may be configured with a plurality of mutually spatially separated chambers each for accommodating different substances of a cleaning and/or care agent. In particular, a cartridge may comprise a plurality of chambers which can be filled with mutually different cleaning and/or care agents. In this manner, a combined use of cleaning and/or care agents is made possible.

In an exemplary embodiment, the cartridge comprises at least one outlet opening, which is configured in a manner such that a gravity-operated release of substance from the container in the position of use of the dosing device may be carried out. Because of this, no other propellants are required to release substances from the container, whereupon the construction of the dosing device is simple, and the manufacturing costs can be kept down.

In a further exemplary embodiment, at least one second chamber may be provided to accommodate at least one second flowable or spreadable substance, wherein the second chamber comprises at least one outlet opening, which is configured in a manner such that a gravity-operated release of product from the second chamber is carried out in the position of use of the dosing device. In particular, the provision of a second chamber is then advantageous when substances are stored in the mutually separated containers which cannot normally be stored together in a stable manner, such as bleaching agents and enzymes, for example.

Furthermore, more than two, in particular three to four chambers may be provided in or on a cartridge. In particular, one of the chambers may be configured to dispense volatile substances such as an aromatic substance, for example, into the environment.

In a further exemplary embodiment, the cartridge may be configured as one piece. In this manner, the cartridge, in particular by using a suitable blow molding process, can be cost-effectively produced in a single manufacturing step. The chambers of the cartridge may in this regard be separated from each other by webs or bridges of material, for example.

The cartridge may also be formed in multiple pieces by components which are manufactured by injection molding and subsequently joined together. Furthermore, it is envisageable for the cartridge to be formed in multiple parts in a manner such that at least one chamber, preferably all of the chambers, can be individually removed from the dosing device or inserted into the dosing device. In this manner, if one substance is used to a different extent, it is possible to remove an already empty chamber while the remaining chambers, which could still be full of a substance, remain in the dosing device. In this manner, the individual chambers or their substances can be refilled in a focused and appropriate manner.

The chambers of a cartridge may be fixed together using suitable connecting methods, so that a container unit is formed. The chambers may be fixed to each other releasably or non-releasably by suitable interlocking, force-fitting or material bonded connections. In particular, fixing may be carried out by one or more of the types of connection from the group of snap connections, hook-and-loop connections, press connections, fusion connections, bonded connections, welded connections, soldered connections, screw connections, wedge connections, clamp connections, or snap-fit connections. In particular, fixing may also be carried out by employing a shrink sleeve which is pulled over the entirety of or sections of the cartridge while warm and which when cooled, securely encloses the chambers or the cartridge.

In order to provide the chambers with advantageous residual emptying properties, the base of the chambers may be inclined towards the dispensing opening in the shape of a funnel. Furthermore, the inner wall of a chamber may be configured by a suitable choice of material and/or configuration of the surface in a manner such that adhesion of substance to the inner wall of the chamber is low. This measure also means that the ability of a chamber to empty out residues is further optimized.

The chambers of a cartridge may have the same or different fill volumes. In a configuration with two chambers, the ratio of the container volume is preferably about 5:1; in a configuration with three chambers, it is preferably about 4:1:1, wherein these configurations are particularly suitable for use in dishwashers.

In or on a chamber, a dosing chamber may be provided upstream of the outlet opening in the direction of flow of the substance. By employing the dosing chamber, the quantity of substance which is to be dispensed from the chamber when the substance is released into the environment can be set. This is of particular advantage when the closure element of the dosing device, which acts to dispense the substance from a chamber into the environment, can dispense it all at once and then can be closed without controlling the dispensed quantity. The dosing chamber then ensures that a predefined quantity of substance is released without a direct feedback of the dispensed substance quantity. The dosing chambers may be formed as one piece or in multiple pieces.

In accordance with a further exemplary development, one or more chambers adjacent to an outlet opening may each be provided with a liquid-tight closable chamber opening. As an example, it is then possible to refill substances stored in this chamber through this chamber opening.

In order to ventilate the chambers, ventilation possibilities may be provided, in particular in the upper region of the chamber, in order to ensure pressure equilibration between the interior of the chambers and the environment as the level of the chambers falls. These ventilation possibilities may, for example, be configured as a valve, in particular a silicone valve, micro-openings in the chamber wall, or the like.

In accordance with a further embodiment, if the chamber is not directly ventilated, but rather via the dosing device or is not ventilated at all, for example when flexible containers are used such as bags, for example, then this has the advantage that under the raised temperatures during a wash cycle of a cleaning appliance, a pressure is built up by heating of the contents of the chamber, which forces the substances to be dosed in the direction of the outlet openings, meaning that good residual emptying capacity of the cartridge is obtainable. Furthermore, with packaging of this type, preferably vacuum packaging, there is no danger of oxidation of the substances, whereupon bag packaging or even bag-in-bottle packaging can in particular be appropriately used for substances that are sensitive to oxidation.

Preferably, the volume ratio formed by the volumetric capacity of the dosing device and the fill volume of the cartridge is <1, particularly preferably <0.1, especially preferably <0.05. This means that with the total volumetric capacity given above for the dosing device and cartridge, the overwhelming proportion of the volumetric capacity is taken up by the cartridge and the substance contained therein.

The cartridge usually has a fill volume of <5000 mL, in particular <1000 mL, preferably <500 mL, particularly preferably <250 mL, more particularly preferably <50 mL.

The cartridge may have any shape. As an example, it may be configured in the shape of a cube, a sphere or it could be in the shape of a plate.

The cartridge and the dosing device may in particular have a spatial shape that is such that they ensure as little a loss of useful volume as possible, in particular in a dishwasher.

In order to use the dosing device in dishwashers, particularly advantageously, the device is shaped to reflect the crockery to be cleaned in dishwashers. Thus, it may, for example, be in the shape of a plate, with approximately the dimensions of a plate. In this manner, the dosing device can be positioned in a space-saving manner, for example in the lower basket of the dishwasher. Furthermore, correct positioning of the dosing device is carried out intuitively by the user because it is shaped like a plate. Preferably, the cartridge has a height:width:depth ratio of between about 5:5:1 and about 50:50:1, especially preferably of approximately 10:10:1. Because of the "slim" configuration of the dosing device and the cartridge, it is in particular possible for the device to be positioned in the lower basket of a dishwasher in the compartments intended for plates. This has the advantage that the substances dispensed from the dosing device are dispensed directly into the load for washing and cannot cling to other items to be washed.

Usually, commercial household dishwashers are designed so that larger items to be washed, such as pans or large plates, are intended to be placed in the lower basket of the dishwasher. In order to prevent the user from positioning the dosing device in a non-optimal position in the upper basket, in an exemplary embodiment, the dimensions of the dosing device are such that the dosing device can only be positioned in the compartments provided in the lower basket. In this regard, the width and the height of the dosing device may in particular be between about 150 mm and about 300 mm, particularly preferably between about 175 mm and about 250 mm.

However, it is also possible to construct the dosing device in the form of a cup with an essentially circular or rectangular footprint.

In an exemplary embodiment, at least one, preferably each of the at least two cartridges has a depletion indicator. It may be what is known as an end of life indication, which can indicate that the cleaning and/or care agent accommodated in a cartridge or a chamber of a cartridge is exhausted or almost exhausted. In order to provide a direct optical check on the fill level, at least a section of the cartridge may be formed from a transparent material. Furthermore, an end of life signal may be produced by a residual quantity in the cartridge. In this regard, for example, because the volume of cleaning and/or care agent accommodated in the cartridge is known and because the quantity that is dispensed per executed and/or managed dose of cleaning and/or care agent is known, a calculation may be carried out so that the residual quantity of cleaning and/or care agent inside the cartridge can be calculated.

In order to protect heat-sensitive components of a substance in a cartridge from the effects of heat, the cartridge may be manufactured from a material with a low heat conductivity.

A further possibility for alleviating the influence of heat on a substance in the cartridge is by insulating the cartridge using suitable features, for example by using heat insulating material such as expanded polystyrene, for example, which completely or partially surrounds the cartridge or a chamber of the cartridge in a suitable manner.

When a plurality of chambers is present, a further feature for protecting heat-sensitive substances in a cartridge concerns the disposition thereof with respect to each other. Thus, for example, it may be envisaged that the chambers which contain a heat-sensitive product could be partially or completely enclosed by at least one further chamber filled with a substance, wherein, in this configuration, this substance and this chamber serve as heat insulation for the enclosed chamber. This means that a first chamber which contains a heat sensitive substance is partially or completely surrounded by at least one further chamber filled with a substance so that, when the environment heats up, the heat sensitive substance in the first chamber exhibits a slower temperature rise than the substance in the surrounding chambers.

In order to further improve the thermal insulation, when using more than two chambers, the chambers may be disposed around each other in the manner of the Matryoshka principle, so that a multi-layered insulating layer is formed.

In particular, it is advantageous for at least one substance which is stored in a surrounding chamber to have a thermal conductivity of between about 0.01 and about 5 W/m·K, preferably between about 0.02 and about 2 W/m·K, particularly preferably between about 0.024 and about 1 W/m·K.

In particular, the cartridge may be configured so as to have a stable shape. However, it is also possible to envisage the cartridge as being configured as a flexible packaging, for example as a tube. Furthermore, it is also possible to use flexible containers such as bags, in particular when they are used in accordance with the "bag in bottle" principle in a receiving container which is essentially stable in shape. By using the flexible packaging—in contrast to using the packaging described above, which are stable in shape (cartridge)—a ventilation system to equilibrate the pressure is no longer necessary.

In an exemplary embodiment, the cartridge may have a RFID label which at least contains information regarding the contents of the cartridge, and which can be read in a contactless manner by the sensor unit.

This information may, for example be used in order to select a dosing program stored in the control unit. In this manner, it can be ensured that an optimal dosing program is always used for a specific cleaning and/or care agent. Furthermore, when a RFID label is not present or when a RFID label has an incorrect or defective identification, then it is possible not to dose via the dosing device, and instead to produce an optical or acoustic signal which advises the user of the problem.

In order to exclude misuse of a respective cartridge, the cartridges may also be provided with structural elements which cooperate with corresponding elements of the dosing device in accordance with the key and lock principle so that, for example, only cartridges of a specific type can be coupled to the dosing device. Furthermore, this embodiment illustrates that it is possible for information regarding the cartridge coupled to the dosing device to be transmitted to the control unit, whereupon the dosing device can be controlled in a manner that is specific to the contents of the relevant container.

The outlet openings of a cartridge may be disposed in a line, whereupon a slim, plate-shaped configuration of the dosing device is made possible.

In the case in which the cartridge is in the form of a pan or cup or is grouped in the shape of a pan or cup, it may, however, also be advantageous to dispose the dispensing openings of the cartridge in the shape of an arc of a circle, for example.

In particular, each cartridge may, for example, be configured to accommodate (for example flowable) cleaning and/or care agents. Particularly preferably, a cartridge of this type comprises a plurality of chambers which can each accommodate different substances of a cleaning and/or care agent.

The cartridges may each comprise a cartridge floor which is directed vertically downwardly in the position of use and in which at least two chambers are provided, each with at least one outlet opening disposed at the cartridge floor.

Furthermore, each of the cartridges may be formed from at least two mutually material-bonded connected elements, wherein the connecting edges of the elements run on the cartridge floor outside the outlet openings, and thus the connecting edges do not intersect with the outlet openings.

The material-bonded connection may, for example, be produced by bonding, welding, soldering, pressing or vulcanization.

In an exemplary embodiment, the connecting edge runs along the head, floor and side faces of the cartridge. In this manner, two cartridge elements may in particular be manufactured using an injection molding process, wherein either both elements are formed in the shape of dishes or one element is in the shape of a dish and the second element is in the form of a cover.

In order to construct a two or multi-chamber cartridge, at least one of the two cartridge elements may comprise at least one separating web which, when the elements are joined together, respectively separates two adjacent chambers of the cartridge from each other.

As an alternative to forming one of the cartridges using two dish-shaped cartridge elements, it is also possible for one cartridge element to be a bowl-shaped container with at least one chamber and for the second element to be the cartridge floor or top, which is connected to the bowl-shaped container in a liquid-tight manner along the connecting edge.

Clearly, it is also possible for the cartridge configurations discussed above to be combined together in any suitable manner. As an example, it is possible to form a dual-chamber cartridge from a cartridge element in the form of a dish and a cartridge element in the form of a cover and to dispose a third one- or multi-part chamber on the top or lateral surface of the cartridge which is formed in this manner.

In particular, a further chamber of this type for accommodating a substance may be disposed on the respective cartridge and be configured in a manner such that volatile substances such as aromatic substances are dispensed into the environment of the chamber.

In accordance with an exemplary embodiment, the outlet openings may each be provided with a closure which, when coupled with a dosing device, allows a substance to flow out of the respective chamber and when uncoupled from the cartridge, essentially prevents substances from flowing out. In particular, the closure is configured as a silicone valve.

The cartridge elements forming the respective cartridge are preferably formed from a plastic and may be shaped in a common injection molding process, wherein it may be advantageous to form a connecting web between the two elements which acts as a hinge so that after unmolding, the two elements are folded over to lie next to each other and be material-bonded to each other along the connecting edge.

In a further embodiment, at least one energy source, in particular a battery or accumulator, may be disposed on one or more of the cartridges, preferably on the floor of a respective cartridge. Furthermore, features for electrically coupling the energy source with the dosing device may be provided on the cartridge.

The cartridge may be configured in a manner such that it can be releasably or fixedly disposed in or on the dosing device, for example inside the dishwasher. In an exemplary embodiment, each of the at least two cartridges can be releasably or fixedly coupled to the dosing device. In this manner in particular, for example, exhausted, i.e. empty cartridges can be replaced, or cartridges wherein the substance accommodated in the cartridge has been completely or nearly completely consumed can be replaced. As an example, it is possible to replace each of the at least two cartridges separately or individually. In this manner, only consumed substance such as cleaning and/or care agent from the at least two cartridges is replaced.

Dosing Device

The dosing device comprises the control unit, sensor unit as well as, optionally, at least one energy source necessary for operation. In a further embodiment, the dosing device comprises at least one actuator which is connected to the energy source and the control unit in a manner such that a control signal from the control unit causes movement of the actuator.

In an exemplary embodiment, the dosing device may be formed from a spray-protected housing which prevents spray that may, for example, be produced when a dishwasher is in use from penetrating into the interior of the dosing device.

In an exemplary embodiment, the energy source, the control unit as well as the sensor unit in particular are molded in a manner such that the dosing device is essentially watertight, and the dosing device is thus also capable of functioning even when completely surrounded by liquid. Examples of molding materials that may be used are multi-component epoxy and acrylate molding masses such as methacrylate esters, urethane methacrylate and cyanacrylate, or two-component materials with polyurethanes, silicones, or epoxy resins.

An alternative or supplement to molding is constituted by encapsulation of the components in an appropriately constructed, moisture-proof housing. An embodiment of this type will be described in more detail below.

In an exemplary embodiment, the dosing device comprises at least one first interface which cooperates with a corresponding interface in or on a water-bearing appliance such as, in particular, a water-bearing household appliance, preferably a dishwasher, in a manner such that electrical energy can be transferred from the water-bearing appliance to the dosing device.

In one embodiment, the at least one interface is formed by plug-in connectors. In a further embodiment, the at least one interface may be configured in a manner such that a wireless transfer of electrical energy is possible, for example by induction.

In this regard, particularly preferably, the interfaces are inductive transmitters or receivers of electromagnetic waves. In this manner, in particular, the interfaces of a water-bearing appliance such as a dishwasher, for example, may be configured as a transmitter coil with an iron core operated by alternating current and the interface of the dosing device may be configured as a receiver coil with an iron core.

In one embodiment, the energy source may also be disposed in at least one of the cartridges. This means that the cartridge can be electrically coupled to the dosing device. Because the cartridge is going to be replaced anyway, preferably at intervals, then in this way, an energy supply for the dosing device is guaranteed.

In an exemplary further development, a respective second interface is provided on the dosing device and the water-bearing appliance, such as a dishwasher, in order to transmit electromagnetic signals which in particular represent operational status, measurement and/or management information from the dosing device and/or the water-bearing appliance such as a dishwasher.

In particular, an interface of this type may be configured in a manner such that a wireless transmission of electromagnetic signals is possible. The wireless transmission of data may, for example, be carried out by radio transmission or IR transmission.

Control Unit

In the context of this application, a "control unit" may be a device which is suitable for influencing and/or implementing and/or controlling the transport of material, energy and/or information. The control unit in this regard influences an actuator, for example, with the aid of a control signal. A control signal may comprise information, in particular measurement signals, parameters or the like.

In an exemplary embodiment, through the control unit, dosing of a quantity of cleaning and/or care agent which may be accommodated in the cartridges, for example, may be carried out. Carrying out an appropriate dosing function or dosing a quantity may, for example, be carried out by dispensing cleaning and/or care agent from the cartridges which can be coupled to the dosing device sequentially or simultaneously, continuously or discontinuously. Accordingly, dispensing of the cleaning and/or care agent which may be accommodated in the cartridges can be activated or deactivated in order to carry out either continuous or discontinuous dispensing of the cleaning and/or care agent. Furthermore, for example, a timely dosing function may be carried out, for example based on a control signal from the control unit. In this manner, for example, a substance can be dispensed by the dosing device between cleaning cycles or cleaning operations of a dishwasher. Based on a control signal, the cleaning and/or care agent may be dosed essentially automatically and/or independently. As an example, a user does not need to input any information. Because of the information captured by the control unit from one or more devices for measuring and/or determining information, for example sensors, which will be described in more detail below, a control signal can be generated which enables or carries out or which allows implementation of an appropriate, i.e. based on the information captured using the sensor unit, dosing of cleaning and/or care agents which can be accommodated in the at least two cartridges that may be coupled to the dosing device.

In an exemplary embodiment, a control signal from the control unit may initiate an action, in particular initiate dosing of cleaning and/or care agents that may be accommodated in the at least two cartridges. The action is, for example, implementing or allowing said dosing of cleaning and/or care agents to be carried out. It is also possible for the control signal to take another action or to implement it. As an example, the control signal may be forwarded to a further device, for example an external device. Forwarding may, for example, be carried out via an appropriate interface for the transmission of information, in particular for forwarding the control signal. The control signal may, for example, be forwarded to a display device so that status information, for example, can be displayed, which in particular is displayed optically, acoustically and/or haptically. In this regard, for example, the dosing device may be monitored, controlled and/or managed "from outside". In addition, process information, identification data and/or measurement values captured by the sensor unit may be generated and transmitted to an external device. An external device may, for example, support an appropriate dose based on the control signal. As an example, it is possible to envisage reinforcing the action of a cleaning and/or care agent, for example of a deodorizing substance, by irradiating crockery with UV radiation, in particular UV-C radiation, which is initiated on the basis of the control signal. In the case of essentially automatic dosing of cleaning and/or care agents, this additionally makes dosing, in particular for a user, substantially easier, because no inputs, for example as regards control and/or regulation of the dosing device by the user, are necessary.

In particular, the control unit may be a programmable microprocessor. In an exemplary embodiment, a plurality of dosing programs is stored on the microprocessor, which can initiate dispensing of appropriate cleaning and/or care agents that can be accommodated in the at least two cartridges.

In an exemplary embodiment, the control unit does not have any connection to any control system of the household appliance. This means that no information, in particular electrical and/or electromagnetic signals, is exchanged directly between the control unit and the control system of the household appliance.

In an alternative embodiment, the control unit may be coupled to the existing control system of the household appliance. A direct machine to machine (m2m) coupling is possible. Preferably, this coupling is cableless, in particular constituted by the transmission of electromagnetic waves. It may be cableless, directly via Bluetooth, SubGhz, IrDA, IEEE 802, WLAN, Zigbee, NFC, etc. In this regard, the connected household appliance may have complete or partial autonomy over the dosing device. It is also possible for the dosing device to maintain two cableless connections, one to the machine and the other to another location, for example to the household router, for example using the two WiFi frequencies 2.4 and 5 GHz or a WiFi and SubGHz connection.

As an example, it is possible to position a transmitter on or in a cleaning machine, preferably on or at the dosing chamber provided in the door of the cleaning machine, which wirelessly transmits a signal to the dosing device when the control for the dishwasher activates dosing of a cleaning and/or care agent, for example, from one of the cartridges.

It is also possible to provide an indirect cableless coupling of the dosing device to the controller of the household appliance. This means that both the appliance and the device could be connected to an intermediary device, for example a smart phone or tablet or a speech input device (Amazon Echo). However, it is not a direct machine to machine (m2m) connection. The cableless coupling between the dosing device and intermediary device may be implemented directly via Bluetooth, SubGhz, IrDA, IEEE 802, WLAN, Zigbee, NFC, etc. The intermediary device is cablelessly connected to the controller of the household appliance, for example via Bluetooth, SubGhz, IrDA, IEEE 802, WLAN, Zigbee, NFC, etc.

A plurality of programs for releasing different cleaning and/or care agents may be stored in the control unit.

In an exemplary embodiment, the appropriate program may be called up by appropriate RFID labels or by physical information carriers formed on the container. In this manner, it is possible, for example, to use the same control unit for a plurality of applications, for example to initiate dosing of cleaning and/or care agents.

In order to dose cleaning and/or care agents which in particular have a tendency to turn into gels, the control unit may be configured in a manner such that on the one hand, dosing is carried out in a sufficiently short time period for ensuring a good cleaning result, and on the other hand, the cleaning and/or care agent is not dosed so quickly that the surge becomes gelled. It may, for example, be carried out by carrying out the release at intervals, whereby the individual dosing intervals may be set in a manner such that the correspondingly dosed quantity can be initiated entirely during one cleaning cycle or cleaning operation.

Sensor Unit

In the context of this application, a "sensor" may be a device for measuring and/or determining information, for example a transducer or probe, which can capture physical or chemical properties and/or can capture the material quality of its environment qualitatively or quantitatively as a measured value.

In a further exemplary embodiment, the dosing device may be a device for capturing information, for example it may have a sensor which can determine physical, chemical and/or mechanical parameters from the environment of the dosing device. The sensor unit may comprise one or more active and/or passive sensors for the qualitative and/or quantitative acquisition of mechanical, electrical, physical and/or chemical parameters which are passed to the control unit as information.

In particular, the sensors of the sensor unit may be selected from the group of timers, temperature sensors, infrared sensors, brightness sensors, temperature sensors, movement sensors, strain sensors, rpm sensors, proximity sensors, flow sensors, color sensors, gas sensors, vibration sensors, pressure sensors, conductivity sensors, turbidity sensors, acoustic wave pressure sensors, "lab-on-a chip" sensors, force sensors, acceleration sensors, tilt sensors, pH sensors, moisture sensors, magnetic field sensors, RFID sensors, magnetic field sensors, Hall sensors, biochips, odor sensors, hydrogen sulfide sensors, and/or MEMS sensors.

In particular with preparations the viscosities of which vary widely as a function of temperature, in order to control the volume or mass of the dosed preparations, it is advantageous to provide flow sensors in the dosing device. Suitable flow sensors may be selected from the group of screen flow sensors, magnetic-inductive flow meters, Coriolis method mass flow sensors, vortex method flow sensors, ultrasound method flow sensors, float-type flow measurement, annular piston flow measurement, thermal mass flow measurement, or working pressure flow measurement.

It may also be possible to store a viscosity curve which is dependent on temperature for at least one cleaning and/or care agent in the control unit, wherein dosing is matched by the control unit to the temperature and thus the viscosity of the cleaning and/or care agent.

In a further embodiment, a device for directly determining the viscosity of the cleaning and/or care agent may be provided.

The alternatives discussed above for determining the dosing quantity or the viscosity of a cleaning and/or care agent serve to produce information which is processed by the control unit in a manner such that essentially constant dosing of a preparation is carried out.

In an exemplary embodiment, the sensor unit comprises at least one or more of the devices formed by the group:

at least one device for measuring a conductance;

at least one device for measuring a temperature;

at least one device for determining unpleasant fragrancing substances;

at least one device for determining a loading status;

at least one device for determining a turbidity;

at least one device for determining a degree of soiling;

at least one device for determining a pH;

at least one device for determining a brightness.

The sensor unit may, for example, comprise a device for measuring a temperature and a device for determining fragrancing substances. In addition, the sensor unit may, for example, comprise two devices for measuring a temperature.

The formulation "one or more" of the devices described consequently encompasses any possible combination of the described devices for measuring or determining or capturing information. The formulation "one or more devices" used encompasses the fact that the described device may be present in multiples, i.e. at least twice, in the sensor unit.

The device for measuring a temperature is, for example, at least one sensor which is suitable for capturing a temperature. The temperature sensor is in particular configured to capture a water temperature.

The device for measuring a conductance is, for example, a sensor for capturing the conductivity, wherein in particular, the presence of water or spraying of water, in particular in a dishwasher, can be captured. A device for measuring a conductance may, for example, capture the initial conductivity of washing water at the start of a washing process without a cleaning and/or care agent having been dosed. The measurement of the conductivity may, for example, be carried out using two electrodes to which current is applied. The measured value is the electrical resistance of the liquid that is established. The reciprocal 1/R of this resistance R is the conductivity $\sigma$.

The device for determining fragrancing substances may, for example, comprise one or more electrochemical sensors or be formed therefrom; they are capable of determining the presence of specific aromatic substances or bad odors. In particular, they may, for example, be sensors which can capture sulfur-containing aromatic substances, volatile carboxylic acids, volatile hydrocarbons and/or nitrogen-containing compounds. Examples of sensors of this type may have a surface with signal-generating binder molecules. These signal-generating binder molecules may be connected via a chemical and/or physical backbone to a signal transmitter such as, for example a quantum bit, a nanoparticle, a micelle, a vesicle or a membrane.

The device for determining a loading status may, for example, be a sensor which can capture the number of opening and/or closing procedures of the loading opening of a dishwasher. This may, for example, be implemented via a light sensor, also known as a brightness sensor. A switch which is actuated in the context of opening and/or closing may also be envisaged. By employing a light sensor, for example, the ingress of light into the interior of a dishwasher when opening the dishwasher door may be detected, whereupon, for example, it can be concluded that the washing program is completed, or a user has closed the door having completed loading the dishwasher with crockery.

The device for determining a turbidity may, for example, be used in order to determine the degree of soiling of the items to be washed in the dishwasher, for example crockery. In this regard, a turbidity sensor may be provided, for example. This can also be used to select, for example, a dosing program in the dosing device that is appropriate for the soiling situation that has been determined.

The device for determining a pH may, for example, be a pH sensor which enables a pH to be captured, in particular of a liquid which is inside a dishwasher.

The device for determining a brightness may be a light sensor, for example.

The device for determining a degree of soiling may, for example, be an optical sensor with which information can be captured, for example image information, which allows a degree of soiling inside a dishwasher, for example, to be determined, or also of the water used during a cleaning cycle to be determined.

A data line between a device for measuring or determining information, for example the devices described above, and the control unit may be formed via an electrically conducting cable, or it may be cableless.

A cableless data line is in particular configured to transmit electromagnetic waves. Preferably, a cableless data line is configured in accordance with standards such as, for example, Bluetooth, IrDA, IEEE 802, Zigbee, NFC, etc.

In an exemplary embodiment, the sensor unit is disposed on the floor of the dosing device, wherein in the position of use, the floor of the dosing device is directed vertically downwardly. In this regard, for example, the sensor unit may comprise a device for measuring a temperature (for example temperature sensor) and/or a device for measuring a conductance (for example conductivity sensor). By employing a configuration of this type, it is established that water passing through the spray arms of the dishwasher is applied to the underside of the dosing device, and thus is brought into contact with the device for measuring a temperature. Because the sensor is disposed on the floor, the distance between the spray arms and the sensors is as short as possible, and so the water cools to only a small extent between the outlet from the spray arms and contact with the device for measuring a temperature, so that the temperature can be measured as accurately as is possible.

Energy Source

In the context of this application, the "at least one energy source" should be understood to mean a constructional element of the dosing device which is appropriate for the provision of energy suitable for operating the dosing device. Preferably, the dosing device comprises at least one energy source and the at least one energy source is configured in a manner such that the dosing device is independent, in particular of an external energy source.

Preferably, the at least one energy source provides electrical energy. The energy source may, for example, be a battery, an accumulator, a power supply unit, a solar cell or the like.

In an exemplary embodiment, the energy source is replaceable, for example in the form of a replaceable battery.

A battery may, for example, be selected from the group of alkali-manganese batteries, zinc-carbon batteries, nickel-oxyhydroxide batteries, lithium batteries, lithium-iron sulfide batteries, zinc-air batteries, zinc chloride batteries, mercury-zinc batteries, and/or silver oxide-zinc batteries.

Examples of suitable accumulators are lead accumulators (lead dioxide/lead), nickel-cadmium accumulators, nickel-metal hydride accumulators, lithium ion accumulators, lithium-polymer accumulators, alkali-manganese accumulators, silver-zinc accumulators, nickel-hydrogen accumulators, zinc-bromine accumulators, sodium-nickel chloride accumulators, and/or nickel-iron accumulators.

In particular, the accumulator may be configured in a manner such that it can be recharged by induction.

However, it is also possible to use mechanical energy sources including one or more coil springs, torsion springs or torsion bars, spiral springs, air springs/gas springs and/or elastomeric springs.

The energy source is dimensioned in a manner such that the dosing device can carry out approximately 300 dosing cycles before the energy source is exhausted. Particularly preferably, the energy source can carry out between about 1 and about 300 dosing cycles, more particularly preferably between about 10 and about 300, yet more preferably between about 100 and about 300 dosing cycles before the energy source is exhausted.

Furthermore, features for transforming energy may be provided in or on the dosing device, which produce a voltage by which the accumulator is charged. As an example, these features may be configured as a dynamo which is operated by the flow of water during a washing operation in a dishwasher and thus pass the voltage produced to the accumulator.

In a further exemplary embodiment, the dosing device comprises at least one vibratory atomizer via which it is possible to transfer a cleaning and/or care agent into the gas phase or to maintain it in the gas phase. Thus, for example, it may be envisaged that cleaning and/or care agent could be vaporized, misted and/or sprayed by the vibratory atomizer, whereupon the cleaning and/or care agent is transferred into the gas phase or forms an aerosol in the gas phase, wherein the gas phase is usually air.

This embodiment is particularly advantageous when used in a dishwasher in which a corresponding release of preparation into the gas phase is carried out in a closable rinsing or washing chamber. The cleaning and/or care agent introduced into the gas phase can be uniformly distributed in the rinsing chamber and be condensed on the items to be washed in the dishwasher.

The cleaning and/or care agent released through the vibratory atomizer may be selected from the group of surfactant-containing cleaning and/or care agents, enzyme-containing cleaning and/or care agents, odor-neutralizing cleaning and/or care agents, biocidal cleaning and/or care agents, or antibacterial cleaning, and/or care agents.

By applying the cleaning and/or care agent to the items to be washed from the gas phase, a uniform layer of the corresponding cleaning and/or care agent is applied to the surface of the items to be washed. Particularly preferably, the entirety of the surfaces of the items to be washed is wetted by the cleaning and/or care agent.

In this manner, for example, action can be taken before the start of a cleaning program in a dishwasher which releases water. As an example, by employing a suitable cleaning and/or care agent, the occurrence of bad odors due to biological decomposition processes in food residues clinging to the items to be washed can be suppressed. On the other hand, an appropriate cleaning and/or care agent can cause "soaking" of food residues that might be clinging to the items to be washed, so that during the cleaning program in the dishwasher, they are easily and completely released, in particular at low temperature programs.

Furthermore, after the end of a cleaning program of a dishwasher, a cleaning and/or care agent may be applied to the items to be washed by the vibratory atomizer. In this regard, an antibacterially acting cleaning and/or care agent or a cleaning and/or care agent for modifying surfaces may be applied.

The physical objective is in particular achieved by the use of a dosing device inside a dishwasher, washing machine or clothes dryer.

Various care agents, for example aromatic substances, may be dosed into a clothes dryer.

In a further embodiment, at least one of the devices for carrying out one of the methods described below, which can be carried out with the dosing device and/or is manageable therefrom, is a mobile device. In particular, communication may be made via a communication system between a mobile device, for example a smart phone, laptop, tablet, wearable, computational engine and at least one other device, for example a server.

In accordance with an exemplary embodiment, the dosing device comprises a communication interface. As an example, the communication interface is set up for wired or wireless communication. As an example, the communication interface is a network interface. The communication interface is configured, for example, so as to be able to communicate with a communication system. Examples of a communication system are a local network (LAN), a wide area network (WAN), a wireless network (for example in accordance with the IEEE-802.11 standard, Bluetooth (LE) standard and/or the NFC standard), a wired network, a cellphone network, a telephone network, and/or the internet. A communication system may comprise communication with an external computer, for example via an internet connection.

In accordance with an exemplary embodiment, the dosing device comprises at least one processor and at least one memory with computer program code, wherein the at least one memory and the computer program code are configured in a manner such that with the at least one processor, at least one method according to the aspects of the present disclosure described below, in particular in accordance with aspects 1 to 7, can be implemented and/or managed. The term "processor" should be understood to mean, for example, a control unit, a microprocessor, a microcontrol unit such as a microcontroller, a digital signal processor (DSP), an application-specific integrated circuit (ASIC), or a field programmable gate array (FPGA).

As an example, an exemplary dosing device further comprises features for storing information such as a program memory and/or a central memory. As an example, an exemplary dosing device further comprises respective features for receiving and/or transmitting information via a network, such as a network interface.

An example of a dosing device is or comprises approximately one data processing unit, which is software-based and/or hardware-based, in order to be able to carry out the respective steps of an exemplary method in accordance with aspects of the present disclosure, in particular in accordance with aspects 1 to 7 described below. Examples of a data processing unit are a computer, a desktop computer, a server, a thin client, a computational engine and/or a mobile computer (mobile device), such as a laptop computer, a tablet computer, a wearable, a personal digital assistant, or a smartphone.

In accordance with an exemplary embodiment of the present disclosure, a computer program is also disclosed which comprises program instructions which allow a processor to implement and/or control a method as described herein when the computer program runs on the processor. An exemplary program may be stored in or on a computer-readable storage medium which contains one or more programs.

In accordance with an exemplary embodiment, a computer-readable storage medium is also described which contains a computer program in accordance with the aspects of the present disclosure. A computer-readable storage medium may, for example, be configured as a magnetic, electrical, electromagnetic, optical and/or other type of storage medium. A storage medium of this type is preferably physical (i.e. "tangible"); as an example, it may be configured as a data carrier device. A data carrier device of this type is, for example, portable or permanently installed in a device. Examples of a data carrier device of this type are volatile or non-volatile random-access memories (RAM) such as, for example, NOR flash memories or sequential access memories such as NAND flash memories and/or read only memories (ROM), or read-write memories. The term "computer-readable" should, for example, be understood to mean that the storage medium can be read and/or described by a computer or a data processing unit, for example by a processor.

In accordance with a further aspect, a system is described comprising a plurality of devices, in particular a mobile device and a dosing device, wherein the devices can together carry out a described method.

The exemplary embodiments described above in this description should also be understood to have been disclosed in all combinations. In particular, exemplary embodiments relating to the various aspects should be understood to have been disclosed.

In particular, the description above or below of steps of the method in accordance with preferred embodiments of a method also disclose corresponding features for carrying out the steps of the method using preferred embodiments of a dosing device in accordance with the described aspects of the present disclosure. Similarly, the disclosure of features in a dosing device for carrying out a step of the method also discloses the corresponding step of the method.

In one aspect, the present disclosure concerns a method for dosing substances such as cleaning and/or care agents, wherein the method comprises the following steps of the method:

- measuring and/or determining sensor information using at least one sensor unit;
- determining dosing information based on at least one piece of the measured and/or determined sensor information;
- generating a control signal by a control unit based on the determined dosing information;
- initiating an action based on the control unit signal, in particular initiating dosing of at least one cleaning and/or care agent accommodated in at least two cartridges of at least one dosing device.

In specific embodiments of the method, the at least one dosing device is a dosing device as described herein.

In further embodiments of the method as contemplated herein, the method comprises at least one step which is selected from the group of:

- measuring a temperature;
- measuring a conductance;
- determining a brightness;
- determining unpleasant fragrancing substances;
- determining a pH;
- determining a turbidity;
- determining dosing information based on at least one piece of the determined and/or measured information (temperature, conductance, brightness, unpleasant fragrancing substance, pH, turbidity);
- dosing of machine cleaning and/or care substance based on the determined dosing information, and/or
- combinations thereof.

In further embodiments of the method as contemplated herein, the method is carried out in a household appliance, in particular a washing machine, dishwasher or a clothes dryer, and comprises:

- direct communication of the at least one dosing device with the household machine, or
- indirect communication of the at least one dosing device with the household machine.

Concerning the communication of the at least one dosing device with the household machine, again, reference should be made to the disclosure concerning the dosing device.

In a further aspect, the present disclosure concerns a system comprising:

- at least one dosing device for dosing substances such as cleaning and/or care agents as described herein, and
- a household appliance, in particular a washing machine, dishwasher or a clothes dryer, which together carry out a method as described herein, wherein optionally, at least one dosing device comprises a communication interface.

Further advantageous exemplary embodiments can be discerned from the following detailed description of some exemplary embodiments, in particular in association with the figures. However, the figures serve solely for the purposes of illustration, and not for the determination of the scope of protection. The figures are not true to scale and solely illustrate the general concept by way of example. In particular, features which are contained in the figures should not in any way be assumed to be necessary components of the present disclosure.

BRIEF DESCRIPTION OF THE DRAWINGS

The present disclosure will hereinafter be described in conjunction with the following drawing figures, wherein like numerals denote like elements, and.

DETAILED DESCRIPTION

The following detailed description is merely exemplary in nature and is not intended to limit the disclosure or the application and uses of the subject matter as described herein. Furthermore, there is no intention to be bound by any theory presented in the preceding background or the following detailed description.

Figure 1:
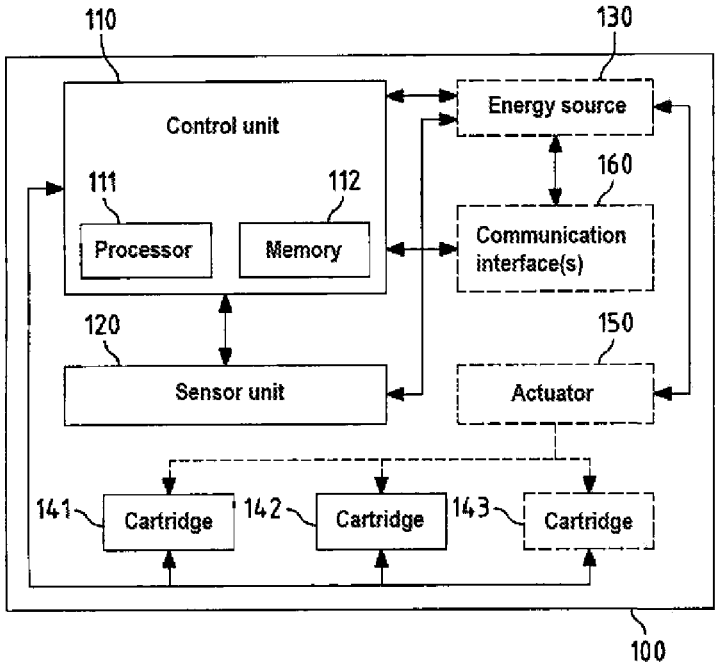
FIG. 1 shows a block diagram of an exemplary embodiment of a dosing device.

FIG. 1 shows a block diagram of an exemplary embodiment of a dosing device 100, which in particular can implement and/or control exemplary methods for dosing substances such as cleaning and/or care agent in accordance with exemplary aspects of the present disclosure. In particular, by employing the exemplary embodiment of a dosing device 100, an exemplary method 200 in accordance with FIG. 2 (aspect 1), 300 in accordance with FIG. 3 (aspect 2), 400 in accordance with FIG. 4 (aspect 3), 500 in accordance with FIG. 5 (aspect 4), 600 in accordance with FIG. 6 (aspect 5) or 700 in accordance with FIG. 7 (aspect 6), as well as an exemplary method in accordance with aspect 7, may be implemented and/or controlled.

The dosing device 100 comprises a control unit 110, a sensor unit 120, at least two cartridges, here cartridges 141, 142 and 143, as well as optional communication interface(s) 160, an optional actuator 150 and an optional energy source 130. An energy source may, for example, be disposed in a cartridge, for example cartridge 143. In this case, the cartridge 143 comprising the energy source is electrically connected to the dosing device 100, so that the dosing device 100 as well as the components comprising the dosing device, in particular the control unit 110 and the sensor unit 120, can use the energy supplied by the energy source.

The sensor unit 120 comprises, for example, one or more devices for measuring and/or determining information. This information may be transmitted from the sensor unit 120 to the control unit 110 for further use or further processing.

Here, the control unit 110 comprises a processor 111 and a memory 112. The memory 112 may, for example, be a program memory, a central memory and/or a data memory. Instructions may be stored in the program memory which, for example, enable the processor 111 to execute appropriate instructions.

As an example, the control unit 110 can evaluate information determined and/or measured by the sensor unit 120 and based on this, a control signal may be generated. The control signal may initiate an action, for example. As an example, the control signal may cause dosing of substances accommodated in the cartridges 141, 142, 143. Furthermore, a control signal may be transmitted to the optional actuator 150, which may be connected to the energy source 130 in a manner such that a movement of the actuator is brought about on the basis of the control signal. As an example, by employing the actuator, dispensing of substances accommodated in the cartridges 141, 142, 143 may be released and cut off, so that these substances can be dosed. A control signal may also be transmitted via the optional communication interface(s) 160 to an external device, for example a UV light so that, for example, crockery inside a dishwasher can be treated.

Information determined and/or measured by the sensor unit 120 may be processed by the control unit 110. As an example, dosing information may be determined on the basis of this measured and/or determined information. For the determination, for example, a cleaning and/or care agent accommodated in the at least two cartridges may be taken into consideration. The processing of this information determined and/or measured by the sensor unit may also be carried out in a decentralized manner, for example on a server, a server cloud, or on an external networkable input/output device (for example a smart phone, tablet, desktop computer or a smart home management system, to name a few examples).

The processor 111 is in particular configured as a microprocessor, microcontrol unit, microcontroller, digital signal processor (DSP), application-specific integrated circuit (ASIC) or field programmable gate array (FPGA).

The processor 111 can execute program instructions which may be stored in the memory 112, and may, for example, store intermediate results, information determined and/or measured by the sensor unit 120 or the like in a central memory (also known as the working memory). As an example, the memory 112 is a non-volatile memory such as a flash memory, a magnetic memory, an EEPROM memory (electrically erasable programmable read only memory) and/or an optical memory. A central memory may, for example, be a volatile or non-volatile memory, in particular a random-access memory (RAM) such as a static RAM memory (SRAM), a dynamic RAM memory (DRAM), a ferroelectric RAM memory (FeRAM), and/or a magnetic RAM memory (MRAM).

Memory 112 is preferably a data carrier that is preferably permanently connected to the dosing device 100. Hard drives that, for example, are built into the dosing device 100, are associated with the data carrier that is permanently connected to the dosing device 100. Alternatively, the data carrier may, for example also be a data carrier that can be removable connected to the dosing device 100, such as a memory stick, a removable disk, a portable hard drive, a CD, a DVD, and/or a diskette.

Memory 112 may, for example, store the operating system and/or the firmware for the dosing device 100 which, upon startup of the dosing device 100, is at least partially loaded into a central memory, for example, and executed by the processor 111. In particular, when starting up the dosing device 100, at least a portion of the core of the operating system and/or the firmware is loaded into a central memory and executed by processor 111. The operating system for the dosing device 100 may, for example, be a Windows, UNIX, Linux, android, Apple iOS, and/or Mac operating system.

In particular, the operating system enables the dosing device 100 to be used. As an example, the operating system administers operating features such as a central memory and a program memory which, for example, may be comprised in the memory 112, optional communication interface(s) 160, and also provides, inter alia, program interfaces for other programs for the basic functions, and controls the execution of programs.

The processor 111 may control the optional communication interface(s) which, for example, may be a network interface and may be configured as a network card, network module and/or modem. Communication interface(s) 160 is in particular configured in a manner such that a connection of the dosing device 100 with other devices, in particular via a (wireless) communication system, for example a network, can be produced (via the communication system), received and transmitted (via the communication system). Examples of a communication system are a local network (LAN), a wide area network (WAN), a wireless network (for example in accordance with the IEEE-802.11 standard, Bluetooth (LE) standard and/or the NFC standard), a wired network, a cellular network, a telephone network, and/or the internet.

Furthermore, the processor 111 may manage and/or control the sensor unit 120.

Figure 2:
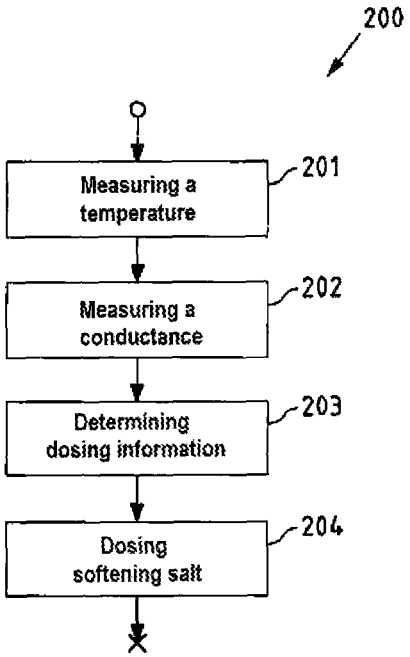
FIG. 2 shows a flow diagram of an exemplary method in accordance with the first aspect, which can be carried out using an exemplary embodiment of a dosing device.

FIG. 2 shows a flow diagram of an exemplary method 200 in accordance with a first aspect (aspect 1), which, for example, can be executed and/or controlled by an exemplary embodiment of a dosing device, for example dosing device 100 of FIG. 1.

The method 200 for dosing softening salt comprises the following steps of the method:

measuring a temperature;

measuring a conductance;

determining dosing information based on at least one piece of the determined and/or measured information;

dosing softening salt based on the determined dosing information.

Here, a sensor unit, for example sensor unit 120 of FIG. 1, comprises at least one device for measuring a temperature and at least one device for measuring a conductance.

The device for measuring a conductance may, for example, undertake two functions. The device for measuring a conductance may, for example, detect the presence of water (for example the start of a washing process in a dishwasher). Furthermore, the device for measuring a conductance may measure an initial conductivity of washing water (without the cleaner, for example, having been dosed). The measurement of the conductivity may, for example, be carried out by employing two electrodes through which current is passed.

The water hardness, for example of washing water, is essentially determined by the cations calcium and magnesium. A specific conductance is established for a specific water hardness, as a function of a dimension (width, length, volume) of electrodes which, for example, may be used for the measurement of the conductance.

The following table shows, for example for a standard electrode, the dependency of the water hardness on the conductivity. The standard electrode is a standard laboratory electrode which had been calibrated against potassium chloride solutions of various concentrations. As an example, it may be a WTW Tetracon 325 Universal conductivity measurement cell (4-electrode graphite cell), measurement range of about 1 μS/cm to about 2 S/cm and 0 to about 100° C.

Overview of water hardness in German and French grades

| ppm | μS/cm | °dH | °f | Hardness |
|---|---|---|---|---|
| 0-70 | 0-140 | 0-4 | 0-7 | very soft |
| 70-150 | 140-300 | 4-9 | 7-15 | soft |
| 150-250 | 300-500 | 9-15 | 15-25 | slightly hard |
| 250-320 | 500-640 | 15-19 | 25-32 | medium hard |
| 320-420 | 640-840 | 19-25 | 32-42 | hard |
| above 420 | above 840 | above 25 | above 42 | very hard |

1 °dH = 1.716 °f; approx. 30 μS corresponds to approx. 1 °dH

Preferably, in steps 201 and 202, both a measurement of a temperature as well as of a conductance are made. The conductance may be strongly temperature-dependent. As an example, the mobility of ions is increased at a higher temperature compared to a temperature which is lower than that temperature. In addition, the degree of dissociation of a liquid rises at higher temperatures, initiated by a fall in the viscosity of this liquid.

When using automatic dishwashers, as is typically the case with a dishwasher, knowledge of the prevailing water hardness can play an important role. Water that has not been softened may, for example, lead directly to spots and limescale deposits on the crockery to be cleaned. In order to avoid this, it is possible to soften the water used, for example. Accordingly, establishing the water hardness for satisfactory performance is sometimes an important parameter.

Substances which can be used as dishwasher products with an integrated softening function usually exploit the principle of crystal growth inhibition using special polymer systems and phosphates in order to inhibit limescale deposits. Variations of sulfonated polyacrylates, ethylenediaminesuccinic acid (EDDS), or methylglycine diacetic acid (MGDA) may be used, for example. These aforementioned substances are readily soluble in water.

Water can be softened with the aid of softening salt. In addition, the performance of dishwasher products with integrated softening functions using softening salt has been enhanced, optimized and/or intensified. This can, for example, be additionally carried out by appropriate dosing of a specific quantity of a softening salt. Because the capacity of a cartridge is restricted, a solution or solutions of said substances and mixtures of substances with as high a concentration as possible should, for example, be stored, for example for repeated dosing. The mixture of substances for softening can furthermore be supplemented with auxiliary materials for automatic dishwashing such as, for example, surfactants, carboxylic acids, solvents, solubility promoters, dyes, aromatic substances, or the like.

Precipitates, in particular alkaline earth carbonate precipitates, may become more intensive with increasing temperature. This may, for example, be caused by the conversion of soluble bicarbonate into insoluble alkaline earth carbonate. Correspondingly, the dosing of softening salt can be matched to the measured temperature. As an example, the temperature may be measured in every respective dishwashing step carried out by a dishwasher and a determination of dosing information may be executed and/or controlled on the basis of the measured temperature.

In order to improve the action of softening salt, dosing of the softening salt may be carried out exclusively in those dishwashing steps in which no dishwasher detergent is dosed such as, for example, in an intermediate washing operation and/or in the rinse aid operation. An intermediate washing operation and/or a rinse aid operation may be included in a cleaning cycle carried out by a dishwasher. Correspondingly, for example, the determination of dosing information in step 203 may be carried out taking the above facts into consideration.

A determination of a dishwashing step is known, for example, from DE 10 2010 062 138 A1, the disclosure of which is hereby explicitly incorporated into the present description. As an example, with the aid of a device for measuring a temperature, a maximum temperature $T_{max}$ may be measured, and after this temperature $T_{max}$ is exceeded, dosing of softening salt may be carried out and/or controlled. This also applies in the case of a rapid drop in a measured temperature dT/dt, which is indicative of a change of water. As an example, the determination of dosing information may involve dosing softening salt based on information of this type. In this manner, dosing of softening salt may be carried out in those dishwashing steps in which no dishwasher detergent is dosed.

Deposit and spot formation can be prevented by employing a measurement of a conductance and dosing information on the basis of this measurement, and by employing dosing softening salt, for example in accordance with the steps 202 to 204. The separate dosing of softening salt may have a further advantage for a consumer, wherein the consumer can dispense with the use of multifunctional products such as, for example, a dishwasher product with an integrated softening function for water. Furthermore, when water hardness is high, for example more than 21° dH, the consumer might dispense with the use of salt and therefore with the associated softening unit. From an ecological viewpoint, dosing of softening salt with the exemplary method 200 may be managed and/or controlled by measuring a temperature and by measuring a conductance. In contrast to this, softening of the water in accordance with the prior art uses multifunctional products in an uncontrolled manner when dosing the softening agent(s) integrated into the dishwasher detergent product. Management and/or control of an appropriate dose is not possible in this case.

Figure 3:
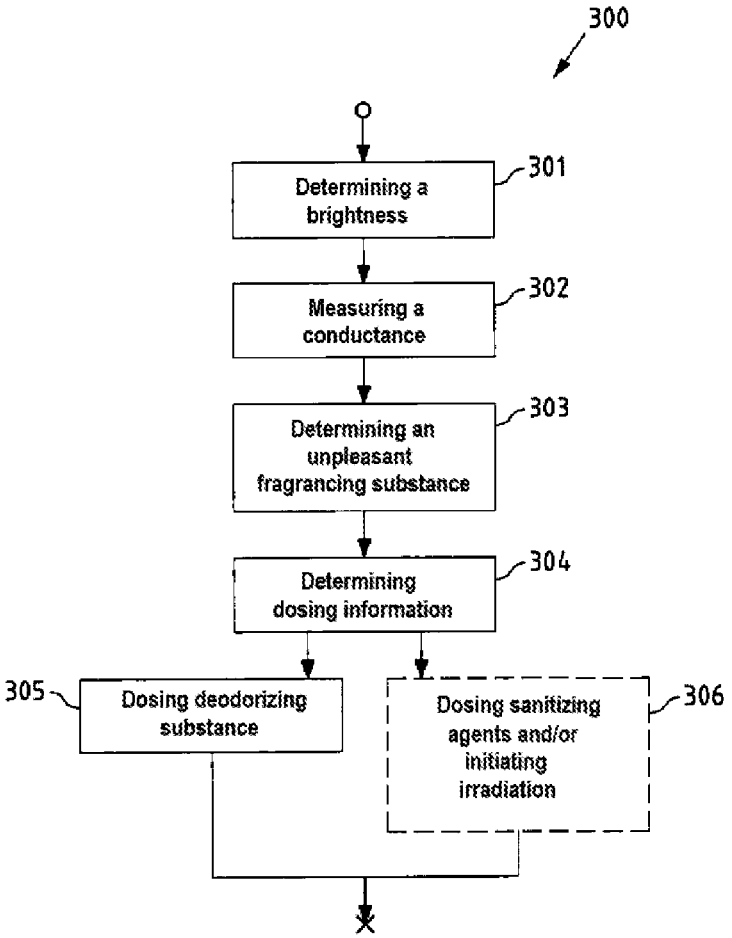
FIG. 3 shows a flow diagram of an exemplary method in accordance with a second aspect, which can be carried out using an exemplary embodiment of a dosing device.

FIG. 3 shows a flow diagram of an exemplary method 300 in accordance with a second aspect (aspect 2) which, for example, may be executed and/or controlled by an exemplary embodiment of a dosing device, for example dosing device 100 of FIG. 1.

The method 300 for dosing deodorant comprises the following steps of the method:

detecting a brightness;

measuring a conductance;

detecting an unpleasant fragrancing substance;

determining dosing information based on at least one piece of the determined and/or measured information (brightness, conductance, unpleasant fragrancing substance);

dosing of deodorizing substance based on the determined dosing information.

Optionally, the method may comprise the following step of the method:

initiating an irradiation, for example of the interior of a dishwasher, in particular with UV radiation, preferably UV-C radiation.

The method as claimed in a second aspect, deodorization may be activated only when deodorization is desired and/or required. To this end, for example, a deodorizing substance may be accommodated in one of the cartridges of the dosing device 100. Deodorization with this deodorizing substance makes end of life signaling possible. Knowing the volume of deodorizing substance accommodated in the cartridge and the quantity which is dispensed per dose of deodorizing substance that is dispensed and/or controlled, a calculation can be carried out so that the residual quantity of deodorizing substance inside the cartridge can be calculated.

In step 301, the detection of a brightness may be determined, for example using a light sensor. The light sensor outputs information when a dishwasher door is opened. As a rule, a user will load soiled crockery into a dishwasher by opening the dishwasher door. Determination of dosing information in step 304 can then be carried out on the basis of a determined brightness, such that dosing of deodorizing substance may be carried out and/or managed in the event that a dishwasher has been loaded with soiled crockery. In this manner, bad odors sometimes caused by the soiled crockery can be covered up by deodorizing substance.

If the determination of dosing information in step 304 is additionally based on a conductance measured in step 302, then through the measured conductance, a determination may be carried out as to whether a washing program has been started. If a washing program has not been started, then as a rule, loading is being carried out.

Furthermore, for example, dosing information based on a number of loading procedures may be obtained which, for example, can be counted and determined via the detection of a brightness in step 301. To this end, for example, a processor, for example processor 111 in accordance with FIG. 1, may determine the number of loading procedures based on information captured by a device for determining brightness. On the basis of this information from the device for determining a brightness, the time difference between two loading procedures may also be determined, for example, and in step 304, appropriate dosing information may be obtained. Correspondingly, in step 305, dosing of a deodorizing substance may be carried out, for example at set intervals of time and/or, for example, when a predetermined time interval has been exceeded.

In step 304, detection of an unpleasant fragrancing substance, for example by employing a device for detecting an unpleasant fragrancing substance, may be carried out. This may, for example, be one or more electrochemical sensors which are capable of detecting and/or identifying the presence of specific aromatic substances or sulfur-containing fragrancing substances, and/or volatile carboxylic acids, and/or volatile hydrocarbons. In one embodiment, the sensor may generate a signal when a threshold is exceeded. In this regard, the threshold may be set relatively low, because substances which are perceived as unpleasant have a low perception threshold in human beings. A signal which is generated when a threshold is exceeded may be indicative of the presence of an unpleasant fragrancing substance.

Unpleasant fragrancing substances may, for example, be decomposition products from microbial activity, so that this can be considered to be an indirect indicator of the prevailing sanitation conditions inside a dishwasher.

In addition to dosing deodorizing substances, in step 305, dosing of sanitizing agents may also be carried out and/or controlled in optional step 306. As an example, the sanitizing agents may be microbiocides of any type, in particular microbiocidal fragrancing substances. Furthermore, the signal which is generated when a threshold, for example predetermined, is exceeded, may, in step 306, optionally initiate the in-situ production of biocidal substances. Examples of biocidal substances are ozone or chlorine dioxide, which may be obtained by electrochemical or physical reactions. Based on the information measured and/or determined in steps 301 to 303, a determination of dosing information may be carried out in step 304, which is indicative of an appropriate dose of deodorizing substance. Subsequently, in step 305, the appropriate dosing may be carried out. Optionally, in step 306, irradiation may be initiated which, for example, may be carried out using an external irradiation device. Unpleasant fragrancing substances may, for example, be neutralized by irradiation with UV radiation, in particular with UV-C radiation.

Dosing or releasing a deodorizing substance as well as sanitizing agents accommodated in a cartridge may, for example, be carried out by any active (electro)mechanical method such as, for example, by gravimetric dosing from a reservoir, pumping, spraying, misting and evaporation, or by opening a sluice. Equally, passive methods without actuating an actuator such as actuator 150 in accordance with FIG. 1, for example, such as by vaporization, diffusion, sublimation or the like in order to dose a deodorizing substance, as well as sanitizing agents, is also possible. Dosing of deodorizing substance as well as of sanitizing agents may alternatively, for example, be carried out by employing a chemical reaction such as, for example, by the decomposition of an oxygen carrier such as hydrogen peroxide catalyzed by heavy metal ions, iodide or hydroxide ions in order to obtain oxygen, or the decomposition of potassium permanganate with sulfuric acid in order to produce ozone-rich oxygen.

Figure 4:
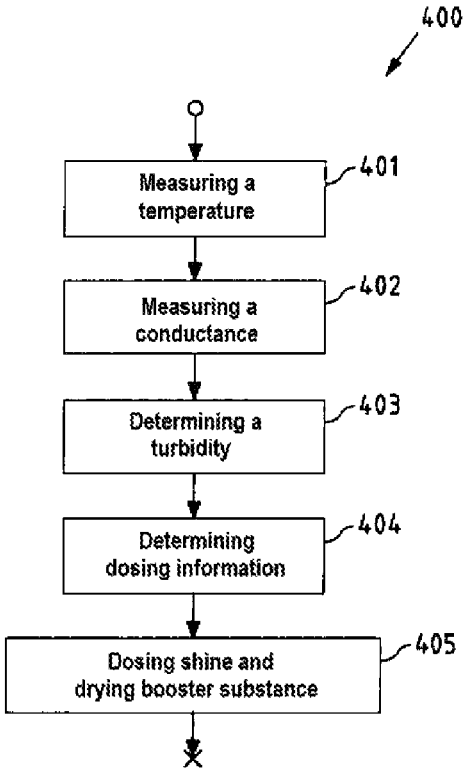
FIG. 4 shows a flow diagram of an exemplary method in accordance with a third aspect, which can be carried out using an exemplary embodiment of a dosing device.

FIG. 4 shows a flow diagram of an exemplary method 400 in accordance with a third aspect (aspect 3) which, for example, may be executed and/or controlled by an exemplary embodiment of a dosing device, for example dosing device 100 of FIG. 1.

The method 400 for dosing shine and drying booster substance comprises the following steps of the method:

measuring a temperature;

measuring a conductance;

detecting a turbidity;

determining dosing information based on at least one piece of the determined and/or measured information (temperature, conductance, turbidity);

dosing of shine and drying booster substance based on the determined dosing information.

Modem dishwasher products are usually multifunctional products in which, inter alia, a limited quantity of rinsing surfactants is present to boost the shine and drying of crockery. Dosing is carried out before a cleaning cycle is begun by adding the product. In order to boost the shine and drying, the rinsing surfactants have to be entrained into the rinsing operation, also described as carry-over. Too low a quantity of carried-over rinsing surfactant can result in poor shine and drying boosting.

Accordingly, in step 405, method 400 provides for separate dosing of shine and drying booster substance. The dosing in step 405 is carried out based on dosing information generated in step 404. Separate dosing of shine and drying booster substance in particular results in good shine and drying boosting when one or more of the following conditions are satisfied:

a) the temperature in the rinsing operation is very low;
b) the temperature in the main washing operation was very high;
c) several intermediate washing operations were carried out;
d) a warm prewash operation has been carried out;
e) a heating rate (dT/dt, wherein T is a temperature) in the main washing operation was very high;
f) a lot of grime was carried in;
g) very little surfactant was carried in.

In order to detect these conditions, in steps 401 to 403, temperature measurement may be measured, conductivity measurement may be measured, and a turbidity may be determined and/or controlled. The measured and/or generated information may, for example, be evaluated by the control unit 110 and dosing information may be determined on the basis of this information. For the conditions set out above, the following information must respectively be measured and/or generated:

a) temperature;
b) temperature;
c) temperature and conductance;
d) temperature;
e) temperature;
f) conductance and turbidity;
g) turbidity.

The conditions set out above may be evaluated taking the following information into consideration, so that an appropriate determination of dosing information is possible:

a) too low a temperature=poor drying;
b) high temperature in main washing operation=high grime load, poor carry-over, grime carry-in;
c) several intermediate washing operations=poor carry-over;
d) warm prewash=high grime load, poor carry-over;
e) high heating rate=high risk to plastic crockery (low thermal capacity), poor drying;
lot of grime in rinse=poor shine boosting, possibility of residues on crockery;
g) low surfactant quantity=poor shine and drying boosting.

In these cases, dosing of shine and drying booster substance which is accommodated in one of at least two cartridges for dosing by carrying out separate addition using a dosing device, for example dosing device 100 in accordance with FIG. 1, can guarantee a sufficient shine and drying boost.

Correspondingly, in step 405, dosing of shine and drying booster substance may be carried out based on the determined dosing information.

Figure 5:
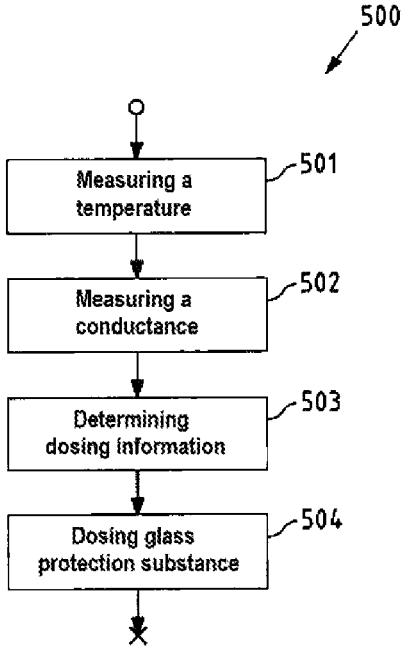
FIG. 5 shows a flow diagram of an exemplary method in accordance with a fourth aspect, which can be carried out using an exemplary embodiment of a dosing device.

FIG. 5 shows a flow diagram of an exemplary method 500 in accordance with a fourth aspect (aspect 4) which, for example, may be executed and/or controlled by an exemplary embodiment of a dosing device, for example dosing device 100 of FIG. 1.

The method 500 for dosing glass protection substance comprises the following steps of the method:

measuring a temperature;
measuring a conductance;
determining dosing information based on at least one piece of the determined and/or measured information (temperature, conductance);
dosing of glass protection substance based on the determined dosing information.

Modern dishwasher detergents are usually multifunctional products in which, inter alia, a limited quantity of substances is integrated which are capable of inhibiting the occurrence of glass and décor corrosion. These substances are also described as glass protection substances. Because substances in these multi-functional products carry over from one washing operation into a next washing operation, the integrated glass protection substance is sometimes deactivated by other ingredients of the dishwasher detergent, for example by precipitation, or it might not be carried over in sufficient quantities.

Method 500 enables glass protection substance to be dosed independently, i.e. separately from other dishwasher detergents. In particular, glass protection substances operate efficiently when they are dosed in washing operations in which no cleaning agent is present. In particular, these operations are prewash operations, intermediate washing operations and rinse operations. As already discussed above in relation to the method in accordance with the first aspect (aspect 1), by measuring a temperature and/or by measuring a conductance, the operational status of a dishwasher can be captured, in particular as regards which section of the process, i.e. operation of a cleaning cycle, is active.

The measurement of a temperature and the measurement of a conductance are carried out and/or controlled in step 501 and step 502. Based on these measured values, dosing information may be determined in step 503. Taking the present discussion into consideration, in step 504, dosing of glass protection substance may be carried out, based on the determined dosing information, exclusively in those sections of a cleaning cycle carried out by a dishwasher, in which no further cleaner or cleaning agent is present.

Figure 6:
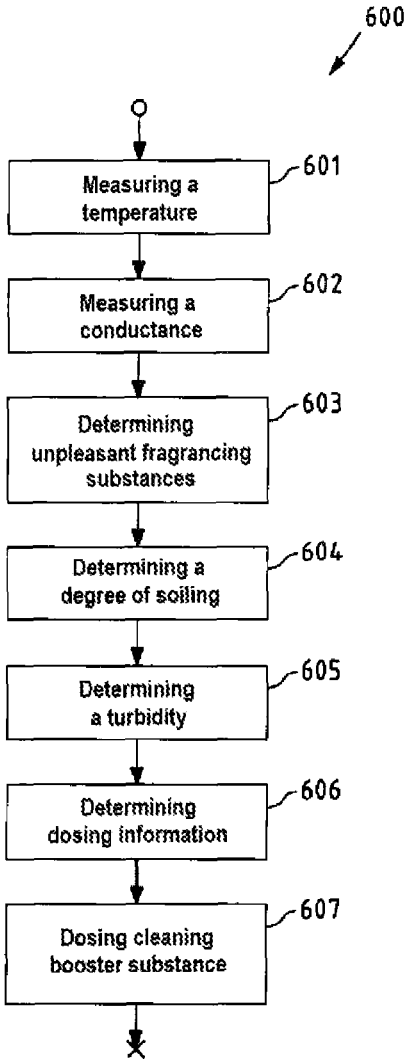
FIG. 6 shows a flow diagram of an exemplary method in accordance with a fifth aspect, which can be carried out using an exemplary embodiment of a dosing device.

FIG. 6 shows a flow diagram of an exemplary method 600 in accordance with a fifth aspect (aspect 5) which, for example, may be executed and/or controlled by an exemplary embodiment of a dosing device, for example dosing device 100 of FIG. 1.

The method 600 for dosing cleaning booster substance comprises the following steps of the method:

measuring a temperature;
measuring a conductance;
detecting unpleasant fragrancing substances;
detecting a degree of soiling;
detecting a turbidity;
determining dosing information based on at least one piece of the determined and/or measured information (temperature, conductance, unpleasant fragrancing substance, soiling, turbidity);
dosing of cleaning booster substance based on the determined dosing information.

Multi-functional dishwasher detergents as a rule comprise a series of ingredients which act to strengthen the cleaning power, which are also described as cleaning booster substances. These may, for example, be enzymes, alkalization agents, surfactants, sanitizing agents, bleaching agents, as well as bleaching catalysts.

In order to ensure sufficient cleaning power under specific conditions which are listed below, the method 500 allows for separate dosing of cleaning booster substance which, for example, may be accommodated in one of the cartridges of a dosing device 100 in accordance with FIG. 1. It should be understood that repeated dosing may be carried out. Furthermore, dosing of cleaning booster substance may be carried out at any time within a cleaning cycle carried out by a dishwasher. The time may, for example, be determined by a control unit, for example the control unit 110 in accordance with FIG. 1, and corresponding dosing information may be determined which includes the specific time. In this manner, in step 606, dosing of cleaning booster substance may be carried out and/or controlled based on this specific dosing information.

As an example, different cleaning booster substances may be accommodated in cartridges 141, 142, 143 of FIG. 1. Sometimes, different cleaning booster substances such as, for example, bleaching agents and enzymes, have to be stored separately because of their reactivity towards each other.

The following conditions by way of example during a cleaning cycle of a dishwasher could make dosing of a cleaning booster substance necessary in order to be able to obtain sufficient cleaning power:

a) very severe soiling of the items to be washed (for example crockery) and/or of the dishwasher→dose enzyme and surfactant cleaning booster substances;
b) use of a liquid cleaner without bleach→dose bleaching agent and/or bleaching system cleaning booster substances;
c) hard burned-on surface soiling→dose alkalization agent and enzyme cleaning booster substances;
d) high grease load→dose surfactant cleaning booster substances;
e) microbiotic load/contamination→dose bleaching agent and/or sanitizing agent cleaning booster substances;
f) fall in cleaning temperature, for example to save energy→dose enzyme and bleaching catalyst cleaning booster substances;
g) shortening program run time (cleaning cycle run time) →dose enzyme and alkalization agent cleaning booster substances;
h) using a lower quality cleaner→dose bleaching agent and/or bleaching system and/or enzyme cleaning booster substances.

In this manner, dosing of cleaning booster substances, in addition to functioning as a cleaning booster, also contributes to saving energy, water and time (see in particular the situations f) and g) set out above).

In steps 601 to 605, for independent implementation of the method 600 in particular, information can be captured which, for example, enables a control unit, for example control unit 110 in accordance with FIG. 1, to carry out the cleaning process and to determine dosing information from the measured and/or generated information (see step 606). Based on the determined dosing information, in step 607, dosing of cleaning booster substance may be carried out and/or controlled.

Figure 7:
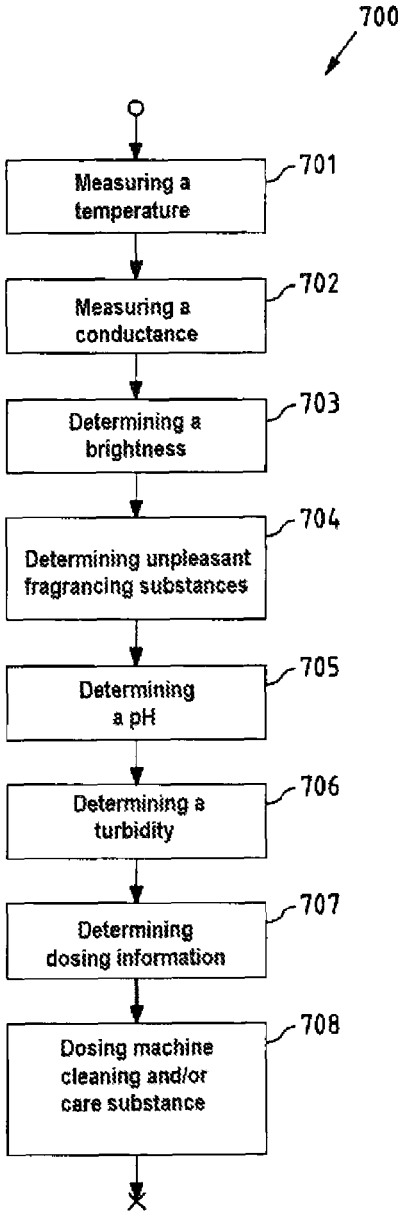
FIG. 7 shows a flow diagram of an exemplary method in accordance with a sixth aspect, which can be carried out using an exemplary embodiment of a dosing device.

FIG. 7 shows a flow diagram of an exemplary method 700 in accordance with a sixth aspect (aspect 6) which, for example, may be executed and/or controlled by an exemplary embodiment of a dosing device, for example dosing device 100 of FIG. 1.

The method 700 for dosing machine cleaning and/or care substances comprises the following steps of the method:

measuring a temperature;
measuring a conductance;
detecting a brightness;
detecting unpleasant fragrancing substances;
determining a pH;
detecting a turbidity;
determining dosing information based on at least one piece of the determined and/or measured information (temperature, conductance, brightness, unpleasant fragrancing substance, pH, turbidity);
dosing of machine cleaning and/or care substance based on the determined dosing information.

Multi-functional dishwasher detergents as a rule comprise ingredients which prevent the build-up of grime deposits. These are also described as machine cleaning and/or care substances. An example of an application which may be mentioned is that the higher the prevailing water hardness, the more critical is the required inhibiting action of the ingredients. This is required in order to prevent the formation of deposits of limescale, grime and grease. In order to ensure that a dishwasher functions properly, it may be necessary to remove these deposits using machine cleaning and/or care substances. Frequently, care of the machine is not a high priority, or is neglected by the user of a dishwasher.

The method 700 illustrates that this cleaning can essentially be carried out automatically. To this end, for example, a cartridge of a dosing device, for example dosing device 100 in accordance with FIG. 1, may comprise a machine cleaning and/or care substance.

On the one hand, it is possible to carry out almost continuous cleaning and care, for example carried out during the course of a cleaning cycle, and on the other hand, temporary cleaning and care may be carried out, for example at predetermined time intervals.

Specific dosing information may include time information which, for example, determines measured and/or determined information based on a sensor unit, for example sensor unit 120 in accordance with FIG. 1. The action of dosed machine cleaning and/or care substance is in particular efficient in operations in which no or only a little cleaning activity is occurring. Correspondingly, for example, dosing may be carried out in particular in a later post-washing phase of a cleaning operation or in an operation following this cleaning operation. Correspondingly, in steps 701 to 705, information may be measured and/or generated with which the current operation of a cleaning cycle can be determined, for example through a control unit. Furthermore, dosing of machine cleaning and/or care substances may be carried out at the start of water circulation. This may also be determined by the information measured and/or determined in steps 701 to 705.

Corresponding dosing information is determined in step 707, on the basis of which, in step 708, dosing of machine cleaning and/or care substances for cleaning and/or care in a dishwasher is possible.

An exemplary embodiment in accordance with a seventh aspect of a method for dosing substances such as cleaning and/or care agents comprises the following steps of the method:

measuring and/or determining sensor information using at least one sensor unit;
determining dosing information based on at least one piece of the measured and/or determined sensor information;

generating a control signal by a control unit based on the determined dosing information;

initiating an action based on the control unit signal, in particular initiating dosing of at least one cleaning and/or care agent accommodated in at least two cartridges of a dosing device.

Other exemplary embodiments comprise one or more of the following aspects, which may be respectively combined with each other and also be combined with one or more claims:

Aspect 8: a dosing device which is configured or comprises appropriate agents for carrying out and/or controlling a method as claimed in one of claims 1 to 9 and/or one of aspects 1 to 7.

Aspect 9: a dosing device comprising at least one processor (111) and at least one memory (112) with computer program code, wherein the at least one memory (112) and the computer program code are configured in a manner such that with the at least one processor (111), at least one method as claimed in one of claims 1 to 9 and/or one of aspects 1 to 7 can be carried out and/or controlled.

Aspect 10: a computer program which comprises program instructions which allow a processor (111) to execute and/or control a method as claimed in one of claims 1 to 9 and/or one of aspects 1 to 7 when the computer program is executed on the processor (111).

Aspect 11: a computer-based storage medium which contains a computer program in accordance with one of the methods as claimed in one of claims 1 to 9 and/or one of aspects 1 to 7.

The exemplary embodiments of the present disclosure described in this specification and the associated respective optional features and properties described should also be understood to have been disclosed in any combinations thereof. In particular, in addition, the description of a feature comprised in one exemplary embodiment—unless explicitly stated otherwise—should not be construed here to mean that the feature is essential or vital to the function of the exemplary embodiment. The sequence of the steps of the method described in this specification in the individual flow diagrams is not mandatory; alternative sequences for the steps of the method may be envisaged. The steps of the method may be implemented in various manners, and so an implementation in software (through program instructions), hardware or a combination of the two may be envisaged for the purposes of implementing the steps of the method.

Terms such as "comprise", "provided with", "contained", "contain" and/or the like in the patent claims do not exclude other elements or steps. The formulation "at least partially" includes both the "partially" and also the "completely" cases. The formulation "and/or" should be understood to mean that both the alternatives and also the combination thereof are disclosed, and so "A and/or B" means "(A) or (B) or (A and B)". The use of the indefinite article does not exclude a plurality. An individual device may carry out the functions of several units or devices cited in the patent claims. Reference numerals given in the patent claims should not be considered to be limitations upon the corresponding means and steps.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the various embodiments in any way. Rather, the foregoing detailed description will provide those skilled in the art with a convenient road map for implementing an exemplary embodiment as contemplated herein. It being understood that various changes may be made in the function and arrangement of elements described in an exemplary embodiment without departing from the scope of the various embodiments as set forth in the appended claims.

The invention claimed is:

1. A system including a dosing device for dosing a first agent and a second agent comprising:

a sensor unit for determining a parameter of an environment;

at least two cartridges for respectively accommodating the first agent and the second agent, wherein the at least two cartridges are coupled to the dosing device, a control unit configured to control dosing of the first agent and the second agent into the environment in response to the parameter of the environment; and a communication interface configured for coupling a control signal generated in response to the parameter of the environment to a UV light.

2. The system including a dosing device for dosing the first agent and the second agent as claimed in claim 1, wherein each of the at least two cartridges accommodates at least one of the first agent and the second agent chosen from:

A) a cleaning booster substance;

B) a shine and drying booster substance;

C) a softening salt;

D) a glass protection substance;

E) a deodorizing substance;

F) a machine cleaning substance; and/or

G) a care substance.

3. The system including a dosing device for dosing the first agent and the second agent as claimed in claim 1 wherein at least one of the at least two cartridges is detachably coupled to the dosing device.

4. The system including a dosing device for dosing the first agent and the second agent as claimed in claim 1 wherein at least one of the at least two cartridges has a plurality of mutually spatially separated chambers for accommodating mutually different agents.

5. The system including a dosing device for dosing the first agent and the second agent as claimed in claim 1 wherein at least one of the at least two cartridges comprises a depletion indicator.

6. The system including a dosing device for dosing the first agent and the second agent as claimed in claim 1 wherein the sensor unit comprises at least one of the devices from the group of:

A) at least one device for measuring a conductance;

B) at least one device for measuring a temperature;

C) at least one device for determining unpleasant fragrancing substances;

D) at least one device for determining a loading status;

E) at least one device for determining a turbidity;

F) at least one device for determining a degree of soiling;

G) at least one device for determining a pH; and

H) at least one device for determining a brightness.

7. The system including a dosing device for dosing the first agent and the second agent as claimed in claim 1 wherein a quantity of the first agent and the second agent is dosed by the control unit.

8. The system including a dosing device for dosing a first agent and a second agent as claimed in claim 1 wherein a control signal from the control unit activates of dosing of the first agent and the second agent accommodated in the at least two cartridges.

9. The system including a dosing device for dosing the first agent and the second agent as claimed in claim 1 wherein the dosing device comprises at least one actuator connected to the control unit such that a control signal from the control unit activates a movement of the actuator.

10. A method of using the system as claimed in claim 1 inside a dishwasher, a washing machine, or a clothes dryer.

11. The system including a dosing device for dosing the first agent and the second agent as claimed in claim 1, further comprising a household appliance chosen from a washing machine, dishwasher, or a clothes dryer.

12. The system including a dosing device for dosing the first agent and the second agent as claimed in claim 1 wherein each of the at least two cartridges is detachably coupled to the dosing device.

13. The system including a dosing device for dosing the first agent and the second agent as claimed in claim 1 wherein each of the at least two cartridges comprises a depletion indicator.

14. A system comprising:

at least two cartridges each accommodating an agent; and a dosing device coupled to the at least two cartridges and configured to dose the agent accommodated by the at least two cartridges with the dosing device comprising:

a sensor unit adapted to determine a parameter of an environment;

a control unit configured to control dosing of the agent in response to the parameter of the environment; and a communication interface for transmitting a control signal generated in response to the parameter of the environment to a UV light.

* * * * *